United States Patent [19]

Bennett

[11] 4,295,801

[45] Oct. 20, 1981

[54] FLUID-POWERED SUBMERSIBLE SAMPLING PUMP

[76] Inventor: Robert W. Bennett, 5116 Bonham, Amarillo, Tex. 79110

[21] Appl. No.: 62,364

[22] Filed: Jul. 31, 1979

[51] Int. Cl.[3] ..... F04B 47/08

[52] U.S. Cl. ..... 417/397; 417/403; 417/390; 91/313

[58] Field of Search ..... 417/390, 403, 404, 393, 417/397; 91/313, 329, 348

[56] References Cited

U.S. PATENT DOCUMENTS

| | | | |
|---|---|---|---|
| 1,448,486 | 3/1923 | Garraway | 91/313 X |
| 2,182,062 | 12/1939 | Sproull | 417/403 |
| 2,642,045 | 6/1953 | Potts | 417/397 X |
| 2,798,435 | 7/1957 | Armstrong | 417/234 X |
| 2,948,224 | 8/1960 | Bailey et al. | 417/393 |
| 3,064,582 | 11/1962 | Knights | 417/393 X |
| 3,247,668 | 4/1966 | Van Hecke et al. | 91/348 X |
| 3,312,172 | 4/1967 | Harklau et al. | 91/329 X |
| 3,412,646 | 11/1968 | Johnston | 417/403 X |
| 3,771,912 | 11/1973 | Conlee | 417/397 |
| 3,779,671 | 12/1973 | Lybecker et al. | 417/393 |
| 4,050,858 | 9/1977 | Apparatus | 417/390 X |

FOREIGN PATENT DOCUMENTS

| | | | |
|---|---|---|---|
| 325269 | 9/1920 | Fed. Rep. of Germany | 91/329 |
| 2161459 | 6/1973 | Fed. Rep. of Germany | 417/397 |

*Primary Examiner*—Leonard E. Smith

*Attorney, Agent, or Firm*—William R. Laney; Robert M. Hessin; Lucian Wayne Beavers

[57] ABSTRACT

A small diameter fluid-driven pump for subterranean fluid sampling, and including an elongated cylindrical body formed by a centrally disposed control valve block assembly and a pair of hollow motor piston chambers on opposite sides of the valve block and joined thereto. Within the centrally disposed control valve block assembly in axial alignment with the motor pistons are a spool pilot valve and a spool fluid distribution valve. The spool pilot valve is constructed to obviate stalling during its reciprocation under the impress of a power fluid directed thereto, and it functions to control the shifting of the distribution valve to which it is internally connected within the valve block assembly.

The spool pilot valve includes a valve housing defining a large central piston chamber, a relatively small bore extending axially inwardly from one end of the valve housing, and into communication with the large central piston chamber, and a larger bore of smaller diameter than the central piston chamber extending axially into the opposite end of the valve housing into communication with the central piston chamber. A small piston is slidably positioned in the relatively small bore, a larger piston in the larger bore and a largest piston in the central piston chamber. A power fluid charging port communicates with the central piston chamber through the valve housing, and inlet and exhaust ports communicate with each of the bores. Sealing means on the largest piston in the central piston chamber allows power fluid to bleed from the power fluid charging port to opposite sides of the largest piston when this sealing means is directly aligned with the power fluid charging port.

25 Claims, 17 Drawing Figures

FLUID-POWERED SUBMERSIBLE SAMPLING PUMP

BACKGROUND OF THE INVENTION

1. Field of the Invention

This invention relates to submersible, fluid-powered pumps, and more particularly to compact, small diameter pumps useful for obtaining liquid samples from deep subterranean locations via a borehole into which the pump is lowered.

2. Brief Description of the Prior Art

A number of fluid-powered pumps have been heretofore developed which utilize some type of small pilot valve of the spool type. In some of these, the pump is double-acting and includes pump pistons at opposite ends of the pump housing which alternately draw in and discharge a fluid to be pumped. Fluid-powered pumps of this general type include submersible pumps of a type adapted for use in oil wells. Examples of these types of pumps are those illustrated in Charles English U.S. Pat. Nos. 3,135,210; 3,336,941; 3,109,379; 3,024,733; 2,989,005 and 2,983,227.

Another design of pump which utilizes a spool type pilot valve to control the movements of a pair of pump pistons is that which is shown in Netherlands Pat. No. 41635. This patent depicts a fluid pump-motor arrangement in which a pair of main pistons are interconnected for mutual reciprocation, with control of their movement effected by a spool-type pilot valve which periodically shifts a spool-type distribution valve which directs power fluid to one of the cylinders in which the two main pistons are located, and concurrently exhausts spent power fluid from the other of the two main piston cylinders.

I have previously constructed a small diameter piston type pump containing an automatic cycle device and intended for expeditiously obtaining subterranean fluid samples. These pumps were utilized by the U.S. Geological Survey for this purpose. The pump was limited, however, in the operating pressure of the power fluid used to drive the pump, and was limited in the depth from which the fluid sample could be pumped.

These early pumps which I conceived and constructed had a pump housing diameter of 1.8 inches and an overall assembled length of 30 inches and weighed about 12 pounds. The prior pump, however, was difficult to start when it was installed at the end of 1600 feet of tubing bundle required to convey the power fluid to the pump. It contained an automatic cycling device which tended to stall or center when the pump was shut down. When the automatic cycling device was centered, a complicated procedure was then required to start the pump by relocation of the cycling device.

My prior pump was also less than optimum in that several small diameter external tubes or parts were required for construction of that pump, and it was therefore necessary to place a protective sleeve around the external tubes to shield the entire pump from damaging contact, and snagging in the borehole into which it was lowered. Moreover, the types of parts utilized in my earlier pump did not permit interchange of those parts from one pump to another, and therefore field replacement of some of the parts was impossible.

GENERAL DESCRIPTION OF THE PRESENT INVENTION

The present invention provides a compact, small diameter fluid-powered sampling pump useful for collecting a fluid sample from deep subterranean locations.

Broadly described, the sampling pump of the invention includes a cylindrical body assembly which comprises a hollow cylindrical upper motor piston chamber, a hollow cylindrical lower motor piston chamber and a cylinder connector which interconnects the upper and lower motor piston chambers and is positioned therebetween. The cylinder connector is of novel configuration and construction to accommodate, in a compact spatial arrangement, a pilot valve subassembly and a distribution valve subassembly. The pilot valve subassembly is interconnected with the distribution valve subassembly and with a source of pressurized power fluid so that shifting of the valve spool included in the pilot valve subassembly effects shifting of the distribution valve which in turn distributes the power fluid to the motor piston chambers. In a preferred embodiment of the invention, the pump is double acting by reason of the inclusion of two motor piston chambers and a pair of interconnected motor pistons which are slidably mounted therein.

Connected to each of the motor pistons located in the upper and lower motor piston chambers are a pair of pump pistons which move in pump piston chambers connected to the respective motor piston chambers. Each pump piston chamber is associated with a valve subassembly which includes an intake and a discharge valve for taking in the fluid to be sampled during one portion of the reciprocating stroke of one of the motor pistons and its associated pump piston, and discharging such sampled fluid during the reversed stroke of the respective motor piston and associated pump piston. Manifold tubing is laid into recesses provided along the cylindrical body assembly, including the respective pump piston chambers, so that the discharge valves of each of the pump valve subassemblies are manifolded to each other, and convey the sampled fluid to the upper end of the pump where it is passed into flexible tubing extending in a tube bundle to the surface. The recessing of the manifold tubing utilized in the pump into the peripheral external walls of the pump body assures the achievement of maximum reduction in overall diameter of the pump, permitting it to be lowered into small diameter bore holes for sampling purposes. A reel assembly is provided at the surface for the purpose of raising and lowering the pump carried at the lower end of the tube bundle.

An important object of the invention is to provide a compact, small diameter fluid sampling pump which can efficiently sample significant quantities of a subterranean fluid from a deep location in the earth.

A further object of the invention is to provide a fluid sampling pump which utilizes only two fluid conveyance tubes or conduits located external to the pump body, which tubes are recessed into the body to protect them from damaging contact with a borehole in the earth during raising and lowering of the pump.

Another object of the invention is to provide a fluid sampling pump of small diameter which contains interchangeable and quickly replaceable parts so that field repair or replacement of parts can be quickly and easily accomplished.

An important object of the invention is to provide a fluid sampling pump which includes a stall-free, pivot valve-distribution valve combination which enables trouble-free start-up of the pump and obviates stalling of the pump at any time during operation.

A further object of the invention is to provide a fluid sampling pump which can generate high fluid discharge pressures utilizing a relatively low pressure power fluid delivered to the pump from a surface location when the pump is lowered to a substantial depth in a borehole.

A further object of the invention is to provide a small diameter lightweight pump which can be easily transported to and from a field location and lowered by means of a compact, relatively easily transported reel assembly into a deep wellbore so as to produce fluid discharge pressures in the course of sampling of up to 2500 psi at a flow rate of over 4 gal/hr.

Additional objects and advantages of the invention will become apparent as the following detailed description of a preferred embodiment is read in conjunction with the accompanying drawings.

GENERAL DESCRIPTION OF THE DRAWINGS

DETAILED DESCRIPTION OF A PREFERRED EMBODIMENT OF THE INVENTION

Figure 1:
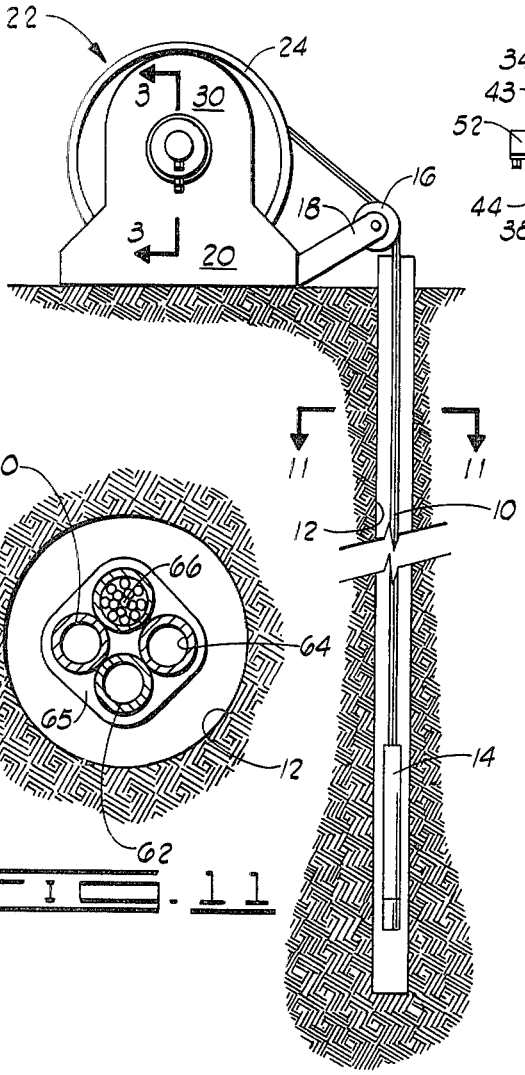
FIG. 1 is a diagrammatic illustration of the fluid-powered submersible sampling pump of the invention as it appears when lowered on a suspending tube bundle into a borehole in the earth from a reel assembly located at the surface.

Referring initially to FIG. 1 of the drawings, the overall pump assembly of the invention is there illustrated, including a tube bundle or harness 10 which is extended downwardly in a borehole 12. At its lower end the tube bundle 10 supports a fluid-powered sampling pump 14 constructed in accordance with the present invention. The tube bundle 10 extends over a suitable sheave or pulley 16 cantilevered at the end of a supporting arm 18 which projects from a reel base 20 or foundation supported on the ground at the surface adjacent the borehole 12. A large tube bundle reel assembly 22 is supported upon the base 20.

Figure 2:
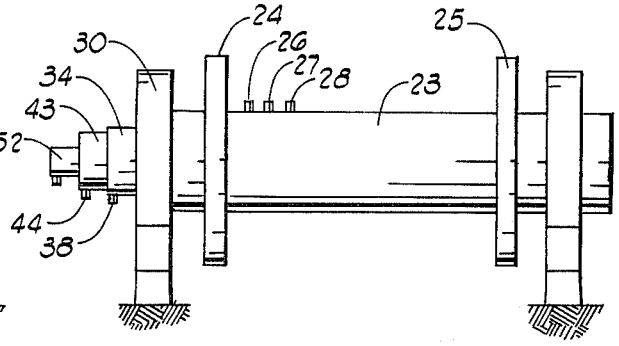
FIG. 2 is a side elevation view of the reel assembly with the tube bundle reeled thereupon removed to facilitate explanation of the construction of the reel assembly.
Figure 3:
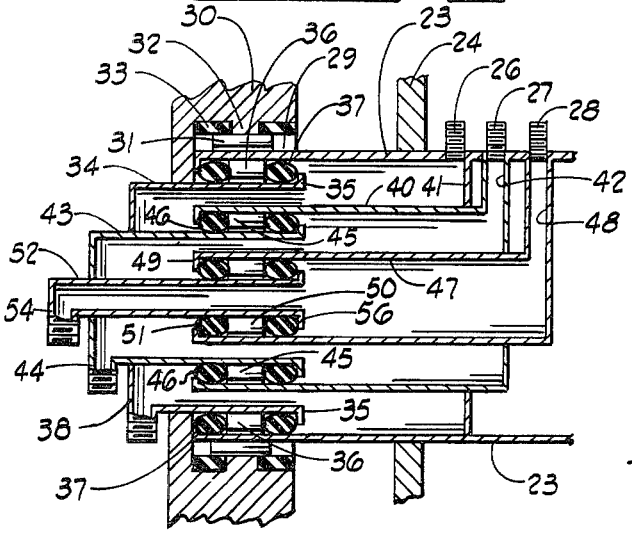
FIG. 3 is a horizontal sectional view, taken in a vertical plane along the central longitudinal axis of a drum forming a part of the reel assembly 22, and explaining the manifolding used to charge and receive various fluids from tubings included in a tube bundle carried on the drum.

One form of the tube bundle reel assembly 22 is illustrated in FIGS. 1–3. The reel assembly 22 includes an outer peripheral drum 23 which carries a pair of reel stop disc plates 24 and 25 spaced axially therealong. The assembly further includes three threaded fittings 26, 27 and 28 which are tapped into the outer periphery of the drum and used for interconnecting the ends of the flexible conduits or tubing included in the tube bundle 10, and hereinafter described.

The opposite ends of the drum 23 extend into journal recesses 29 provided in vertically projecting pillow blocks 30 of the reel base 20, and are journalled in these recesses for rotation about an axis extending longitudinally along the drum center line. To facilitate such journalling of the drum 23, a plurality of roller bearings 31 are provided between the outer periphery of the drum and a stationary bearing race 32 formed or secured internally in the recess 29. As thus mounted, the drum 23 and the stop disc plates 24 and 25 carried thereon are free to rotate about the longitudinal axis of the drum, and thus to unreel the tube bundle 10 from the drum in a manner and for a purpose hereinafter described. Each recess 29 also contains a pair of peripheral elastomeric back-up seals 33 which function to provide secondary sealing as hereinafter explained.

In order to permit power fluid from a stationary source to be charged to the fitting 26 via the tube bundle reel assembly, a cylindrical power fluid drum manifold 34, which carries a radial inner lip 35, and which is of substantially smaller diameter than the drum 24, projects through each pillow block 30 and concentrically into one end of the drum 23. The drum manifold 34 is stationary within the end plate 30 and the drum 23 is permitted to turn thereon by means of bearings 36 placed between the outer periphery of the drum manifold 34 and the inner wall of the drum 23. Suitable seals 37 are provided on opposite sides of the bearings 36 to prevent fluid from passing between the drum 23 and the drum manifold 34. A charging neck 38 projects radially outwardly from the outer end of the drum manifold 34 and is threaded to facilitate connection thereto of a pipe used to charge a power fluid, such as compressed nitrogen, from a suitable source to the interior of the power fluid drum manifold 34 and from the interior of this manifold to the fitting 26.

In order to segregate the power fluid used to drive the pump from the sample fluid being pumped, and also from exhaust power fluid returned to the surface from the pump, a cylindrical first isolation manifold 40 is welded concentrically within the drum 23 by means of an annular partition 41. The cylindrical isolation manifold extends into the opening formed through the pillow block 30 and lies concentrically inside the power fluid cylindrical manifold 34. At its outer end, the first isolation manifold carries an internal flange, and at its axial inner end, it communicates with the fitting 27 via a suitable tube 42.

Located concentrically within the cylindrical power fluid manifold 34 is an exhaust power fluid cylindrical manifold 43. The exhaust power fluid cylindrical manifold 43 carries an exhaust fluid discharge neck 44, and is journalled with suitable bearings 45 and seals 46 concentrically within the first isolation manifold 40.

A second cylindrical isolation manifold 47 is positioned concentrically within the drum 23, and is of substantially smaller diameter than the first isolation manifold 40. The second isolation manifold 47 communicates with the threaded fitting 28 by a radial fluid passageway 48. At its axially outer end, the second cylindrical isolation manifold 47 carries a radially inwardly projecting flange 49, and surrounds and journals, by means of suitable bearings 50 and seals 51, a fluid sample receiving manifold 52. The fluid sample receiving manifold 52 is connected at its outer end to a discharge neck 54 by which a fluid sample returned to the surface can be discharged into a suitable pipe or conduit connected to the fluid sample discharge neck. At its inner end the sample receiving manifold carries a radially outwardly projecting flange 56.

It will be perceived that the isolation manifolds are associated with passageways communicating them with the threaded fittings 26, 27 and 28 and are welded inside the drum 23 in fixed concentric relation thereto so as to undergo rotation with the drum as the drum is rotated about its longitudinal axis. These isolation manifolds are journalled over portions of the cylindrical exhaust fluid and sample discharge manifolds so that these elements, as well as the power fluid charging manifold 34, can be retained in a stationary or fixed status during rotation of the drum. The reel assmebly 22 will thus function to permit power fluid from a source at the surface to be charged to the pump via the tube bundle 10 extending downhole to the pump 14, and also to permit exhaust or spent power fluid to be returned to the surface and discharged via the tube bundle reel assembly 22. A sampled fluid pumped to the surface passes through the sample receiving manifold 52 and the sample fluid discharge neck 54 to a point of collection.

Figure 11:
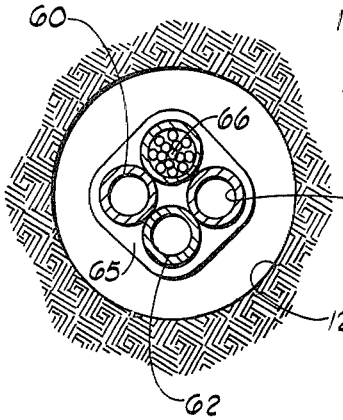
FIG. 11 is a sectional view taken along line 11—11 of FIG. 1.

As shown in FIG. 11, the tube bundle 10 includes a flexible power fluid charging conduit 60, a power fluid exhaust conduit 62 and a fluid sample surface return conduit 64. These flexible conduits or tubes are preferably extended through a plastic outer harness shell 65. The tubes or conduits 60, 62 and 64 are preferably of relatively thick-walled nylon construction. For deep subterranean sampling, the tube bundle 10 preferably also includes an elongated high strength wire or cable 66 which supports the pump 14 at the lower end of the tube bundle.

Figure 4A:
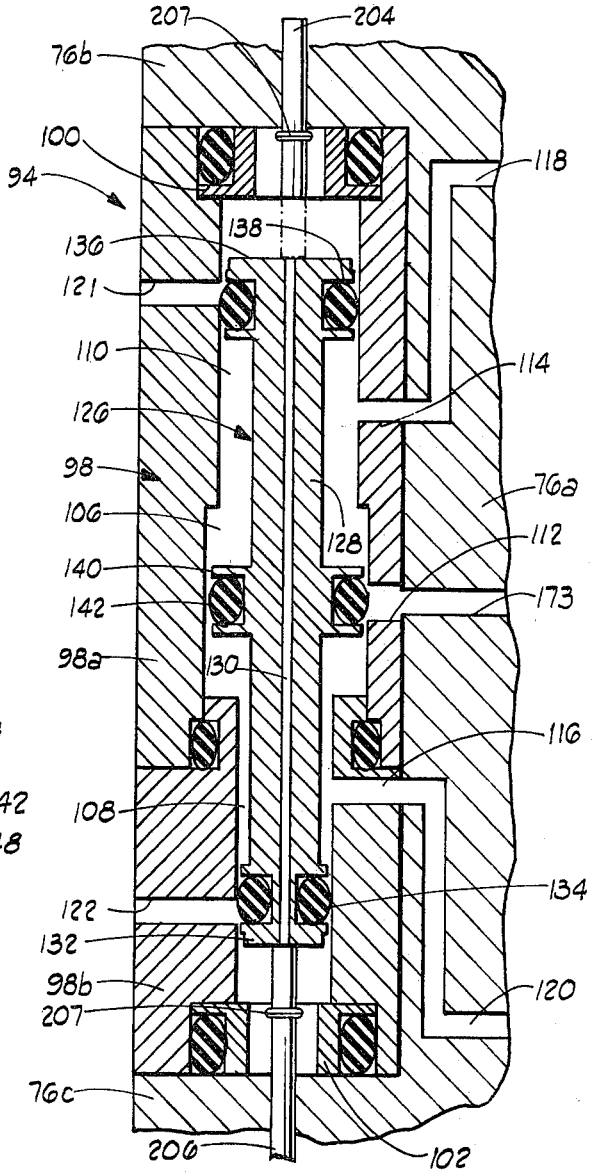
FIG. 4A is a fragmentary view, partially in section and partially in elevation, of a central portion of the sampling pump of the invention, taken in a plane extended through a pilot valve subassembly utilized in the pump and a portion of a cylinder connector forming a part of a central cylindrical body assembly which is included in the pump.
Figure 4B:
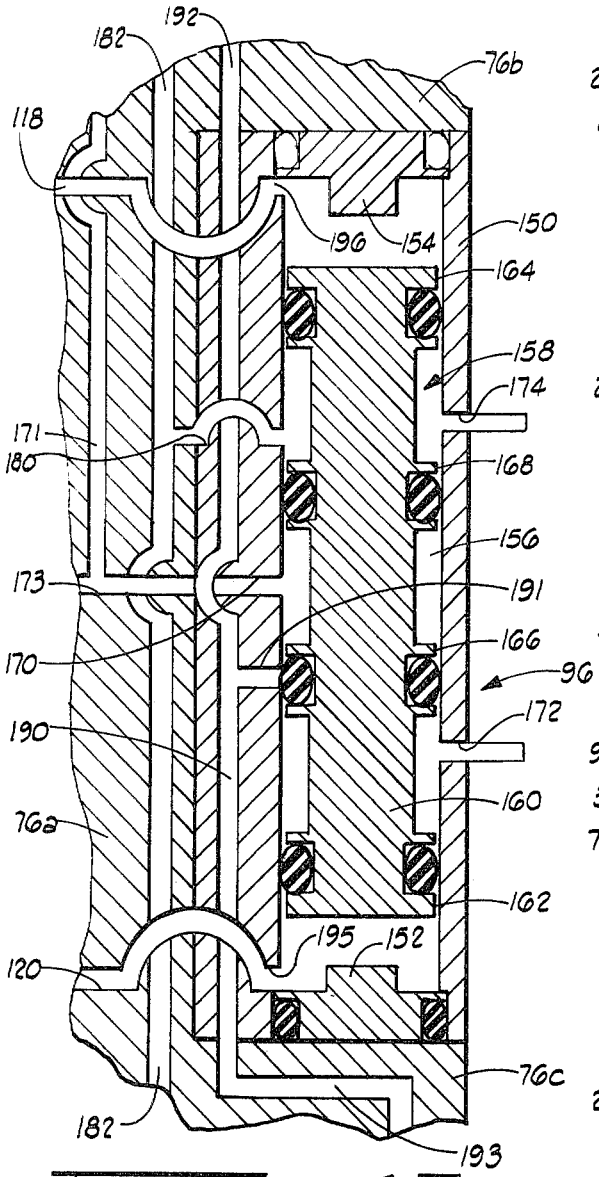
FIG. 4B is a view partly in section and partly in elevation similar to FIG. 4A but illustrating a distribution valve subassembly forming a part of the pump, and also illustrating a part of a cylinder connector which lies adjacent the part of the same structure shown in FIG. 4A.
Figure 7:
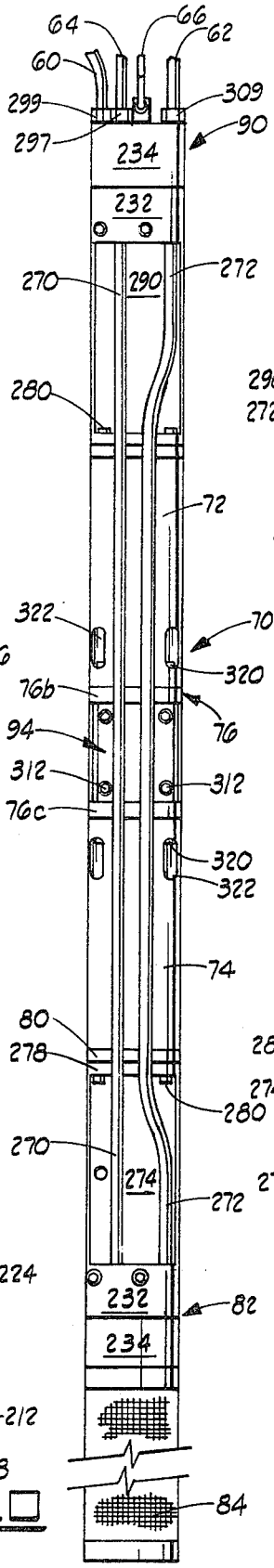
FIG. 7 is a view in elevation of the pump as it is actually constructed.
Figure 5:
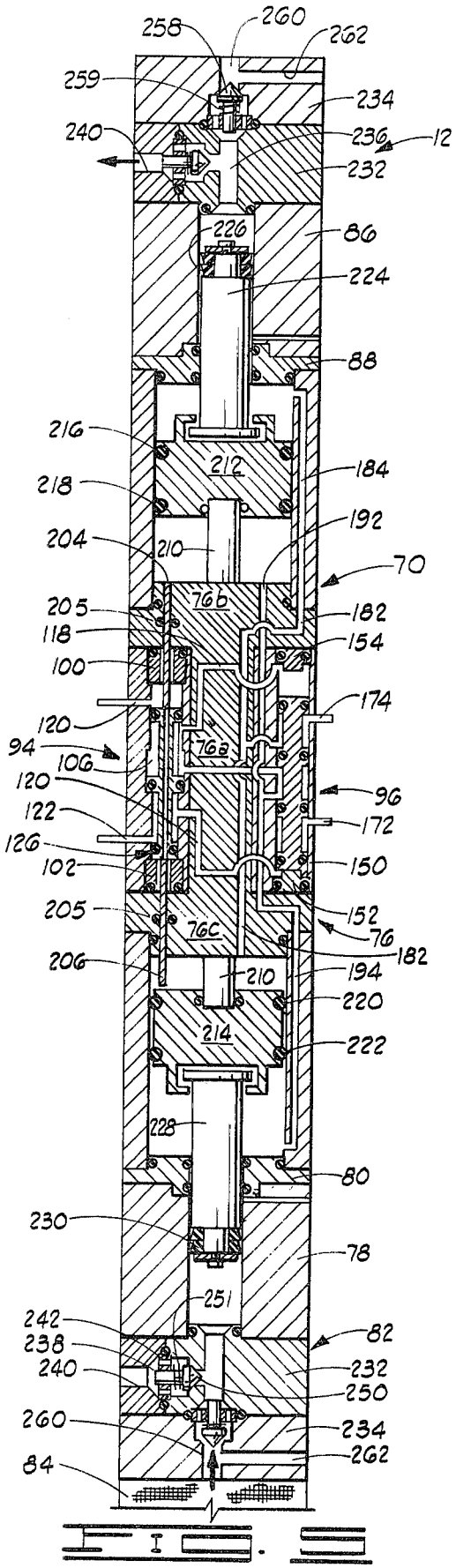
FIG. 5 is a diagrammatic illustration, partly in section and partly in elevation, of the pump of the invention, showing the pump in one pumping status in which a fluid to be sampled is being drawn into the lower end of the pump through an intake or suction valve at that location.
Figure 6:
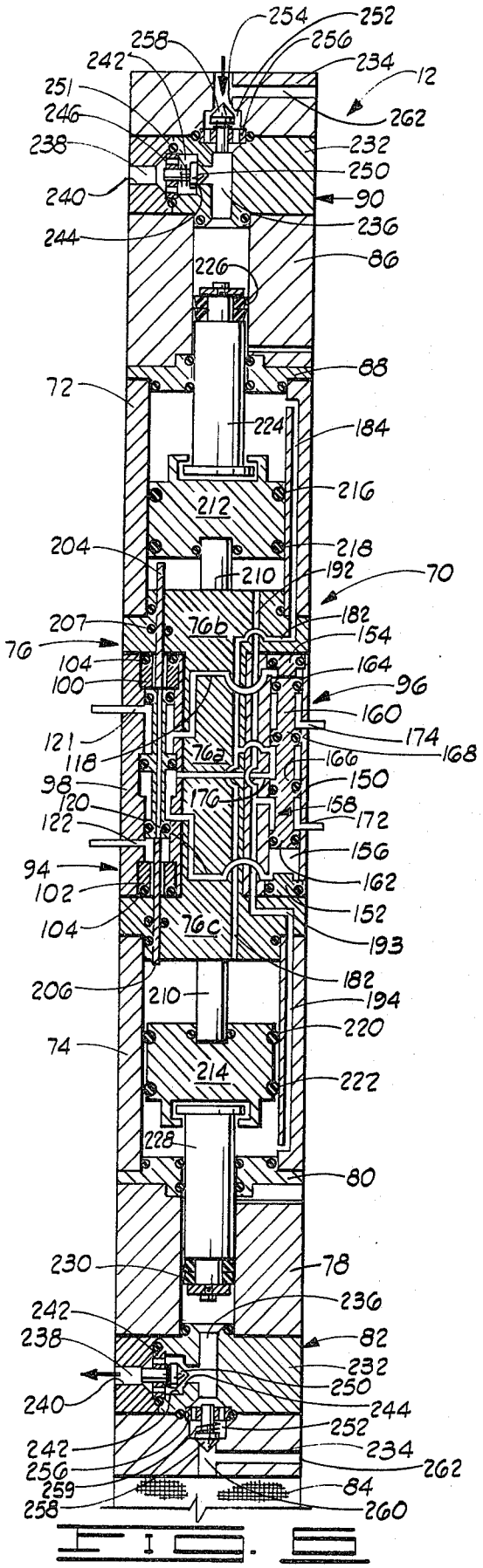
FIG. 6 is a partially sectional, partially elevational view similar to FIG. 5, and illustrating the pump of the invention in a status in which a sampled fluid is being discharged from the lower end of the pump through a port provided for sample fluid collection purposes.
Figure 13:
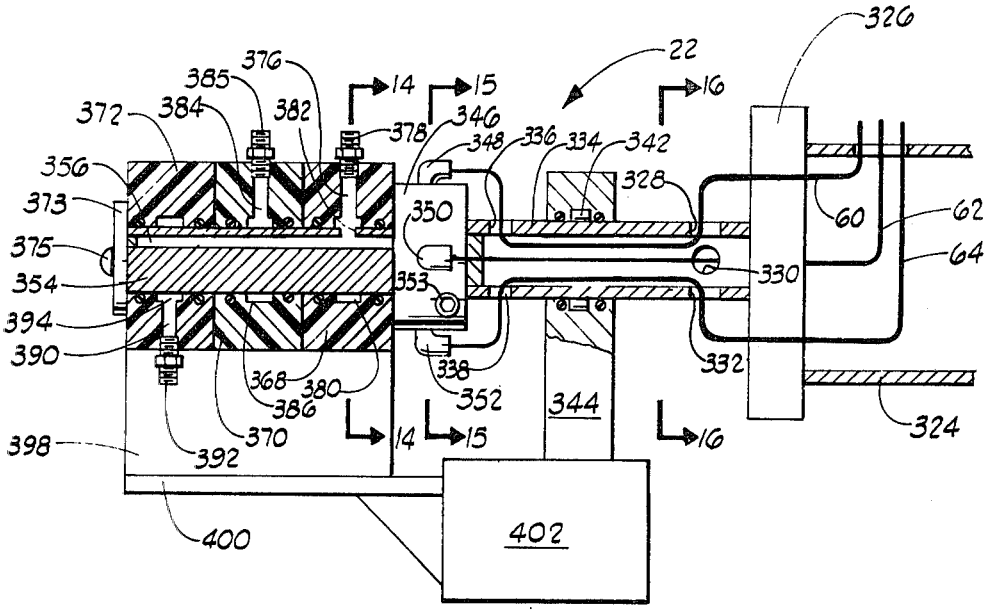
FIG. 13 is a partially diagrammatic view, partially in section and partially in elevation, showing an alternate and preferred embodiment of the reel assembly which can be utilized in the present invention.

The structural details of the pump of the invention, in the context of their functional interrelationship, can best be understood by initially referring to FIGS. 4–6 of the drawings, which are diagrammatic in character. The manner of assembling the several major structural subassemblies to achieve the compactness and mechanical ruggedness of the pump will be subsequently explained as reference is made to FIGS. 7–9 of the drawings.

The pump 14 includes an elongated cylindrical body assembly 70. The cylindrical body assembly 70 includes an upper hollow cylindrical motor piston chamber 72 and a lower hollow cylindrical motor piston chamber 74. A cylinder connector 76 is used for interconnecting the motor piston chambers 72 and 74. A tubular lower pump piston chamber 78 is provided at the lower end of the pump and is connected by any suitable means to the motor piston chamber 74, and is sealed from the hollow interior thereof by a seal plate 80. A first pump valve assembly 82 is connected to the lower end of the lower tubular pump piston housing 78 and may be desirably connected to a suction screen 84.

A similar arrangement is used at the upper end of the pump 12. Here, a tubular upper pump piston housing 86 is connected to the hollow motor piston chamber 72, and is sealed therefrom by a seal plate 88. The upper pump piston housing 86 is connected at its upper end to a second or upper pump valve assembly 90.

Referring in greater detail to the several major parts of the pump as shown in FIGS. 4–6, the cylinder connector 76 is characterized in having an axially extending central portion **76*a* which extends axially within the pump body 70 and interconnects a pair of end plates 76*b* and 76*c*. Mounted between the end plates 76*b* and 76*c* are a spool pilot valve subassembly, designated generally by reference numeral 94, and a spool distribution valve subassembly, designated generally by reference numeral 96. The pilot valve subassembly 94 includes a valve body 98 of cylindrical configuration, which body is bored at its opposite ends to receive a pair of seal plugs 100 and 102 and is of two-part construction, with the parts being denominated by reference numerals 98*a* and 98*b*. The seal plugs 100 and 102 carry annular, peripherally mounted O-rings 104 for sealing against the walls of the bores in which the seal plugs are located, and sealing against the respective end plates 76*b* and 76*c***.

The constructions of the pilot valve subassembly 94 and distribution valve subassembly 96 are schematically illustrated in enlarged detail in FIGS. 4A and 4B of the drawings. In referring to FIG. 4A, it will be perceived that the interior of the valve body 98 of the pilot valve is provided with a relatively large central piston chamber 106, a relatively small piston chamber 108 and a third piston chamber 110 which is of smaller diameter than the central piston chamber 106, but is of larger diameter than the piston chamber 108. The piston chambers 108 and 110 each communicate at one of their ends with the central piston chamber 106, and at their opposite ends with the bores in the body 98 which contain the sealing plugs 100 and 102. The valve body 98 defines a centrally located power fluid charging port 112 which communicates with the large central piston chamber 106 at the central portion thereof, and a pair of distribution valve connecting ports 114 and 116 which are connected to fluid passageways 118 and 120 extending through the central portion 76*a* of the cylinder connector 76 (as shown in FIGS. 5 and 6). Finally, the body 98 of the pilot valve 94 defines a pair of power fluid exhaust ports 121 and 122 from which power fluid is exhausted from the pilot valve during the operation of the pump as hereinafter described.

Located within the hollow interior of the body 98 of the pilot valve 94 is a compound piston subassembly or spool, designated generally by reference numeral 126 (see FIG. 4A). The compound piston subassembly 126 includes an elongated interconnecting piston shaft 128 which has an axial fluid passageway 130 extending through the length of the shaft. Upon one of its ends, and disposed within the relatively small bore 108, the piston shaft carries a relatively small piston 132 which supports a circumferentially extending resilient sealing element 134. At its opposite end, the piston shaft 128 carries a larger diameter piston 136 which is provided around its periphery with an annular resilient sealing element 138. At substantially the center of the piston shaft 128, the shaft carries a large central piston 140 which has an elastomeric sealing element 142 extending around the outer periphery thereof and sealing against the wall of the large central piston chamber 106. The cross-sectional dimension of the sealing element 142 is selected in relation to the diametric size of the power fluid charging port 112 so that, when the sealing element 142 is positioned over this port, as shown in FIG. 4A, power fluid charged to the pilot valve can leak or bleed past the sealing element 142 into the central piston chamber 106, and specifically, into the spaces located on opposite sides of the large central piston 140.

The distribution valve subassembly 96 is disposed on the opposite side of the central portion 76*a* of the cylinder connector 76 from the pilot valve 94. The distribution valve subassembly 96 includes an elongated hollow valve body 150 which has bores at its opposite ends closed by a pair of seal plugs 152 and 154, similarly to the construction of the pilot valve. An elongated central bore 156 extends between the bores at opposite ends of the body 150 and contains a reciprocating compound piston subassembly or spool designated generally by reference numeral 158. The compound piston subassembly 158 includes an elongated piston shaft 160 which has a pair of end pistons 162 and 164 disposed at opposite ends of the shaft. Spaced axially along the piston shaft from the end pistons 162 and 164, and from each other, are a pair of intermediate pistons 166 and 168. It will thus be noted that within the bore 156, the pistons 162–168 define three isolated fluid chambers forming portions of the bore 156 and spaced therealong, with these chambers being of substantially equal volume. It will also be noted that spaces are defined between the end pistons 162 and 164 and the seal plugs 152 and 154 which close the opposite ends of the valve body 150 of the distribution valve subassembly.

A plurality of ports are formed through the valve body 150 to communicate fluids with the elongated central bore 156. Thus, a power fluid charging port 170 is provided through the valve body 150 to facilitate charging power fluid from the flexible power fluid conduit or tubing 60 hereinbefore described to the valve body 150 via an elongated fluid passageway means 171 which extends axially over the length of the pump as hereinafter described, and intersects a transverse passageway 173 in the central portion of the connector 76. A pair of power fluid exhaust ports 172 and 174 are also provided in the valve body 150 to permit spent power fluid to be exhausted into the power fluid exhaust conduit or tubing 62 during operation of the pump.

A power fluid distribution passageway 180 extends through the body 150 of the distribution valve and registers and communicates with a power fluid distribution passageway 182 which extends axially in the central portion 76*a* of the cylinder connector 76, and then extends radially in the end plate 76*b*. The passageway 182 registers and is communicated with a distribution passageway 184 formed in the upper motor piston chamber 72. The distribution passageway 184 terminates near, and opens into, the upper end of the upper motor piston chamber 72. It will further be noted that the fluid distribution passageway 182 formed in the central portion 76*a* of the cylinder connector 76 terminates at its opposite end in a port which opens directly into the upper portion of the lower motor piston chamber 74.

The body 150 of the distribution valve subassembly 96 defines an axially extending fluid distribution passageway 190. At one of its ends, this fluid distribution passageway is aligned and in registry with a fluid distribution passageway 192 formed through the end plate 76*b* and opening directly into the lower portion of the hollow interior of the upper motor piston chamber 72. At its opposite end, the fluid distribution passageway 190 communicates and registers with a fluid distribution passageway 193 which extends through the end plate 76*c* and communicates with the passageway 194 in the wall of the lower motor piston chamber 74. The passageway 194 opens into the lower portion of the hollow interior of the lower piston chamber 74. A pair of control ports 195 and 196 are provided through the body 150 of the distribution valve 96 and communicate and register with control passageways 118 and 120 which are formed through the central portion 76*a* of the connector 76, and which communicate with the ports 114 and 116 formed in the body 98 of the pilot valve subassembly 94.

Extending slidably through the end plates 76*b* and 76*c* of the connector 76 are a pair of pilot valve push rods 204 and 206. Seals 205 are provided around the push rods 204 and 206 within grooves formed in the end plates 76*b* and 76*c* to prevent fluid from leaking along the push rods between the interior of the pilot valve 94 and the open interior of the motor piston chambers 72 and 74. The length of the push rods 204 and 206 is such that the push rods will be reciprocated by the cooperative reciprocating actions of the compound piston subassembly 126 of the pilot valve 94 and of motor pistons located in the upper and lower motor piston chambers 72 and 74 during operation of the pump in a manner hereinafter described. It will also be noted that the push rods 204 and 206 are aligned with the elongated axial passageway 130 which extends along the axis of the piston shaft 128 of the compound piston subassembly 126 of the pilot valve 94, and loosely cover this axial passageway at a time when the end of either of the respective push rods is in contact with the end face of the respective piston 132 or 136. A rib 207 or other suitable stop element is provided on each of the rods 204 and 206 to prevent the rods from being pushed, or falling, through the end plates 76*b* and 76*c*.

An elongated piston connecting rod 210 extends through an axial bore formed in the central portion 76*a* of the cylinder connector 76 and projects from opposite ends of the cylinder connector. The piston connecting rod 210 is secured at one end to an upper motor piston 212 and at its other end to a lower motor piston 214. The upper motor piston 212 is provided with a pair of peripheral O-ring seals 216 and 218 which seal against the internal wall of the upper motor piston chamber 72. In like manner, the lower motor piston 214 is provided with a pair of peripheral O-ring seals 220 and 222 which seal against the internal wall of the lower motor piston chamber 74. It will be noted in referring to FIGS. 5 and 6 that the diametric size and position of the motor pistons 212 and 214 are such that one end face of each of these pistons will contact one end of one of the respective push rods 204 and 206 during operation of the pump, and will drive the respective contacted push rod in reciprocation as the contacting motor piston is reciprocated toward the cylinder connector 76.

Connected to the upper end of the upper pump piston 212 and extending axially upwardly therefrom through the seal plate 88 is an upper pump piston 224. The upper pump piston 224 carries suitable seals 226 around the periphery of the end thereof which slidingly reciprocates within the upper pump piston housing 86.

Similarly, the lower end of the lower motor piston 214 is connected to the upper end of a downwardly extending lower pump piston 228 which carries peripheral seals 230 at its lower end. The lower end portion of the lower pump piston 228 is reciprocably positioned within the bore of the lower pump piston housing 78.

The lower and upper pump valve assemblies 82 and 90 are substantially identically constructed and each includes a discharge valve block 232 secured to the lower end of the respective pump housing 78 or 86 and a suction valve block 234 joined to the discharge block. The discharge valve block 232 defines a central bore 236 and a radial fluid passageway 238 which opens at a port 240 which is threaded or otherwise suitably fitted for connection to a fluid sample tube extending over the length of the pump in an orientation hereinafter described.

The radial fluid passageway 238 defines a valve chamber 242 which houses a frusto-conical valve seat 244 and a spider 246. A movable valve element 250 is reciprocably mounted in the spider 246 and is movable between a closure position on the seat 244, and an open position between the seat and the spider. A spring 251 resiliently urges the valve element 250 toward and against the seat 244. The intake block 234 defines a valve chamber 252 which is bounded at one side by a valve seat 254 and is spanned at its opposite side by a spider 256. A movable intake valve element 258 is configured for seating and closure of the valve by registry with the valve seat 254, and is movable against the resilient bias of a spring 259 to an open position between the valve seat and the spider 256. An axial suction port 260 projects from the valve chamber 252, and intersects a radial suction portion 262 which opens through one side of the intake block 234. In the case of the intake or suction valve structure of the upper pump valve assembly 90, the axial suction port is plugged or blocked in the illustrated embodiment of the invention. The second or upper pump valve assembly 90 is otherwise constructed identically to the lower pump valve assembly 82.

In the operation of the pump 14, power fluid, which preferably comprises a compressed gas such as nitrogen, is charged to the pump via the power fluid charging tubing 60. This flexible conduit is ultimately connected through intermediate tubing and the internal passageway 171, as will be subsequently explained, to the power fluid charging port 170 in the elongated hollow valve body 150 of the distribution valve subassembly 96, and to the power fluid charging port 112 of the spool-type pilot valve subassembly 94. As will be perceived in referring to FIGS. 4A, 4B, 5 and 6, the pressurized power fluid entering the port 170 passes around the elongated piston shaft 160 between the intermediate pistons 166 and 168 forming a part of the spool or compound piston subassembly 158, and the power fluid also passes from the fluid passageway 173 formed transversely through the central portion 76*a* of the cylinder connector 76 to the pilot valve subassembly 94 via the power fluid charging port 112 which opens into the large central piston chamber 106.

The power fluid may be communicated with the hollow interior of the large central piston chamber 106 within the valve body 98 of the pilot valve subassembly 94 at any one of several different statuses of the compound piston subassembly 126. One of these is illustrated in FIGS. 4A and 4B in which the compound piston subassembly 126 is centered in the valve body 98. At this time, the annular elastomeric sealing element 142 is centered over the power fluid charging port 112 but, as previously indicated, power fluid may bleed by this sealing element and into the large central piston chamber 106 on opposite sides of the large central piston 140.

At this time, it will be perceived that the pressurized power fluid is acting upon the faces of the small piston 132 and the relatively large diameter piston 136 which face toward the central piston chamber 106. Since the piston 136 presents the larger surface area to the acting pressure of the power fluid, the compound piston subassembly 126 is caused to shift upwardly as it is viewed in FIGS. 4A and 4B. As the elastomeric sealing element 142 on the large central piston 140 begins to pass over and away from the power fluid charging port 112, the annular resilient sealing element 138 on the relatively larger diameter piston 136 begins to open the power fluid exhaust port 121 in the valve body 98. This exhausts power fluid from the space defined between the central piston 140 and the piston 136.

When the compound piston subassembly or spool 126 has been shifted to the end of its upward stroke, the power fluid entering the power fluid charging port 112 passes through the distribution valve connecting port 116, through the control passageway 120, through the control port 195 in the hollow valve body 150 of the distribution valve subassembly 96 and into the space between the seal plug 152 and the end piston 162 of the reciprocating compound piston subassembly or spool 158. Power fluid entering the distribution valve subassembly 96 at this point acts on the end piston 162 to cause the compound piston subassembly 158 to shift upwardly. The status at this time of both the distribution valve subassembly 96 and the pilot valve subassembly 94 is illustrated in FIG. 6 of the drawings. At this time, spent power fluid is exhausted from the interior of the valve body 150 through the power fluid exhaust ports 172 and 174. Such spent power fluid has been passed into the annular spaces between the two end pistons 162 and 164 and the facing intermediate pistons 166 and 168 from the upper and lower hollow cylindrical motor piston chambers 72 and 74 at different times during the operation of the pump as hereinafter explained. Movement of the compound piston subassembly or spool 158 upwardly, as it is viewed in FIG. 6, will also effectively expel spent power fluid (which has been previously utilized to drive the piston subassembly in the opposite direction), from the space between the end piston 164 and the seal plug 154. This spent power fluid is discharged through the control port 196 into the control passageway 118, thence through the distribution valve connecting port 114 in the valve body 98 of the pilot valve subassembly 94, and from this location out through the power fluid exhaust port 121.

When the compound piston subassembly or spool 126 of the pilot valve subassembly 94 is in the described position (that which is shown in FIG. 6 of the drawings), it is retained in this position by a positive force acting upwardly on the piston subassembly within the valve body 98 by reason of the pressurized power fluid acting on the differential areas of pistons 132 and 140.

It will be perceived that when the pilot valve subassembly 94 is in the described status, and when the distribution valve subassembly 96 is shifted to the position earlier described, the power fluid charged to these valve assemblies is further passed through the power fluid distribution passageway 180 in the valve body 150 of the distribution valve subassembly 96, and from this passageway moves through passageway 182 and passageway 184. Pressurized power fluid is thus applied to the top side of the upper motor piston 212 to impel this piston downwardly in the motor piston chamber 72. Power fluid is concurrently supplied to the space above the lower motor piston 214 and thus drives this piston downwardly in the lower motor piston chamber 74. As previously explained, the two motor pistons are, of course, interconnected by the elongated piston connecting rod 210. In this way, the turnaround of the motor pistons 212 and 214 in the course of their stroke is accomplished, and the downward part of the cycle is commenced.

At this time, exhausted power fluid previously used to drive the motor pistons 212 and 214 in the opposite direction is exhausted from the lower motor piston chamber 74 via the passageway 194 and from the upper motor piston chamber 72 via the fluid distribution passageway 192. The exhaust power fluid from the passageway 194 enters the passageway 193 and from this passageway passes into the axially extending fluid distribution passageway 190 formed in the valve body 150 of the distribution valve subassembly 96. The passageway 190 also receives exhaust power fluid from the passageway 192 which is formed in the plate **76*b* of the cylinder connector 76. The exhaust power fluid from the passageway 190 is enabled to leave the distribution valve subassembly via the power fluid exhaust port 172. This port is communicated in a manner hereinafter described with exhaust power fluid passageway means which is connected to the flexible conduit 64** for return to the surface.

In order to effect any change in the position of the compound piston subassembly or spool 126 within the body 98 of the pilot valve subassembly 94, it is necessary that a force be applied to the end of the push rod 204 which is nearest the upper motor piston 212. As has been explained, the upper motor piston 212 is being moved downwardly at this time. It will ultimately contact the end of the push rod 204 and commence to drive this rod downwardly. As the push rod 204 is moved downwardly, its end which is located inside the body 98 of the pilot valve subassembly 94 contacts the end face of the piston 136 which faces the seal plug 100 and commences to force the compound piston subassembly or spool 126 downwardly within the valve body 98 as the pump is viewed in FIGS. 5 and 6.

As the piston subassembly 126 moves downwardly, the large central piston 140 moves across the power fluid charging port 112. After the port 112 is crossed by the seal 142, pressurized power fluid is permitted to communicate with the space between the piston 136 and the piston 140. At this time, the sealing element 134 on the piston 132 commences to uncover the exhaust port 122 to permit spent power fluid to be exhausted via this port from the body 98 of the pilot valve subassembly 94. Also at this time, the pressurized power fluid charged to the hollow interior of the body 98 of the pilot valve subassembly 94, and specifically, into the space between the pistons 136 and 140 carried on the piston shaft 128 of the compound piston assembly 126, is charged via the port 114 and control passageway 118 to the control port 196 in the body 150 of the distribution valve subassembly 96. This has the effect of placing pressurized power fluid in the space between the end piston 164 and the seal plug 154 so that the compound piston subassembly or spool 158 is caused to move downwardly within the valve body 150, thus reversing the previously described direction of movement of the compound piston assembly or spool of the distribution valve subassembly 96. In this manner, the distribution valve subassembly 96 is shifted to ultimately reverse the direction of movement of the interconnected motor pistons 212 and 214.

In the described status of the pilot valve subassembly 94 and the distribution valve subassembly 96, pressurized power fluid will commence to flow via the port 191 in the body 150 of the distribution valve subassembly into the axially extending fluid distribution passageway 190 therein after the intermediate piston 166 has been shifted in a downward direction, as viewed in FIG. 6, sufficiently to uncover the port 191. With pressurized power fluid thus permitted to enter in the passageway 190, the power fluid can flow from this passageway into the fluid distribution passageway 192 formed in the end plate **76*b* of the cylinder connector 76, and can also pass into the passageway 193 formed in the end plate 76*b* and from thence into the passageway 194. By this route, the pressurized power fluid is charged to the space beneath the upper motor piston 212 and also the space below the lower motor piston 214**, and the direction of movement of both of these motor pistons is reversed and they are caused to commence their upward reciprocation.

In the meantime, the pressurized power fluid, acting upon the relatively large area of the piston 140, as compared to the area of the piston 136, has driven the pilot valve subassembly valve spool or compound piston subassembly 126 all the way downwardly within the body 98 of the pilot valve subassembly, and in doing so, has driven the push rod 206 downwardly as the upper end of this push rod is contacted by the downwardly moving piston 132 carried at one end of the valve spool. The push rod is thus extended from the lower face of the end plate **76*c* of the cylinder connector 76, and is aligned with the lower motor piston 214** in a position to be contacted and driven upwardly by this motor piston in the course of its upward stroke. As the motor piston 214 continues to move upwardly within the lower motor piston housing 74, it contacts the lower end of the push rod 206 and drives the push rod upwardly, in turn causing the pilot valve spool or compound piston subassembly 126 to commence upward movement. During this upward movement of the compound piston subassembly, such exhausted or spent power fluid as has been permitted to bleed through the elongated axial passageway 130 through the piston shaft 128 and into the space between the piston 136 and the seal plug 100 is exhausted through the power fluid exhaust port 122.

A complete cycle of the pump is thus completed as the elastomeric sealing element 142 around the large central piston 140 of the compound piston subassembly 126 crosses over the power fluid charging port 112.

It is here appropriate to point out that the pump of the present invention includes two features which assure that the pump will not stall or become arrested in a dead center position as a result of the elastomeric sealing element 142 blocking the power fluid charging port 112. The first of these is that the elastomeric sealing element is diametrically sized so that some bleed-by of power fluid to the opposite sides of the large central piston 140 occurs, and this bleed-by in turn establishes the differential pressure required to drive the compound piston subassembly 126 upwardly, as the pump is viewed in FIGS. 5 and 6, past the dead center position. The differential pressure, of course, results from the differences in the areas of the piston 136 and piston 140 as such areas are acted on by the pressurized power fluid. The second feature which prevents stalling at a dead center position is the driving action of the push rods 204 and 206, which are in turn driven by the motor pistons 212 and 214 during their reciprocation. In the event the pump is stopped in a dead center position, and should the push rod 204 somehow move into the dashed line position as shown in FIG. 4A, start-up of the pump still can be effectively and quickly accomplished by reason of the bleed-by of power fluid past the sealing element 142.

As the motor pistons 212 and 214 are reciprocated in the manner described, they in turn drive the upper pump piston 224 and lower pump piston 228 in reciprocation within the upper pump piston housing 86 and lower pump piston housing 78, respectively. As the pump pistons 224 and 228 undergo reciprocation, they alternately open and close the intake or suction valve elements and discharge valve elements within the first pump valve assembly 82 and second pump valve assembly 90. Thus, during the upstroke of the pump piston 228 at the time of upward movement of the lower motor piston 214, the intake valve element 258 in the second or lower pump valve assembly 82 is opened, permitting a fluid from the formation adjacent the borehole, and in the borehole, to be drawn through the screen 84, and into the intake or suction valve chamber 252, and up into the space beneath the pump piston 228 within the lower pump piston chamber 78. At this same time, the upward movement of the upper motor piston 212 and upper pump piston 224 has effected the closure of the intake or suction valve 258 in the upper or second pump valve assembly 90.

Concurrently with these actions of the two intake or suction valve elements during the upward movement of the motor pistons 212 and 214 and concurrent upward movement of the pump pistons 224 and 228, the discharge valve element 250 in the lower pump valve assembly 82 is drawn to a closed position upon the seat 244 and the discharge valve element 250 in the upper pump valve assembly 90 is forced off its seat 244 to an open position to permit sample previously drawn into the valve chamber and the space above the upper pump piston 224 to be discharged through the port 240.

These actions of the intake or suction valves and discharge valves in the two pump valve assemblies 82 and 90 are reversed during the down stroke of the motor pistons 212 and 214.

As will be subsequently explained, the discharge ports 240 in the discharge valve blocks 232 of the upper and lower pump valve assemblies 82 and 90 are manifolded so that a common conduit collects the fluid sample being consecutively discharged through each port during the alternate up and down strokes of the pump pistons 224 and 228. This manifolding and common conduit ultimately facilitate passage of the thus collected sample to the flexible conduit 64 provided for returning the fluid sample to the surface.

The actual physical appearance and structural interrelationship of the several parts of a preferred embodiment of the pump of the invention are illustrated in FIGS. 7–10 and 12. The cylindrical body assembly 70 is shown as including the upper hollow cylindrical motor piston chamber 72, the lower hollow cylindrical motor piston chamber 74 and the cylinder connector 76 which includes the disc-shaped end plates 76*b* and 76*c* and the axially extending central portion 76*a*. The lower pump piston chamber 78 and upper pump piston chamber 86 are connected by screws to the ends of the respective motor piston chambers 74 and 72, and are joined to the lower pump valve assembly 82 and upper pump valve assembly 90, respectively. The suction screen 84 is mounted, as previously described, upon the lower end of the pump.

Figure 8:
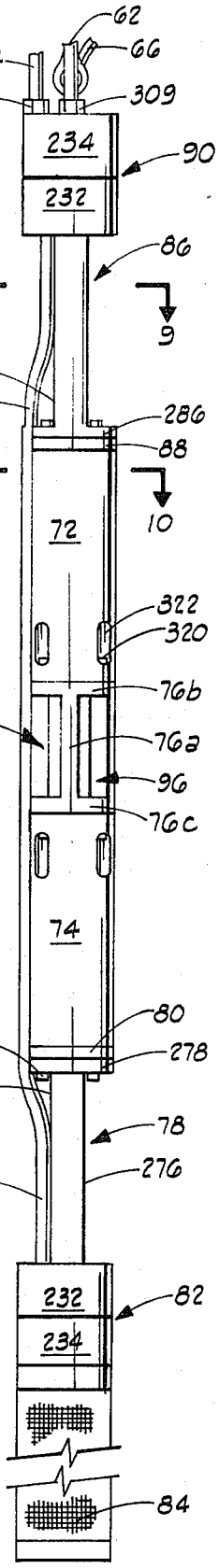
FIG. 8 is a view in elevation of the pump as it is actually constructed in one embodiment, with the pump having been rotated through 90° from the position in which it is viewed in FIG. 7.

An important aspect of the present invention is the very small diameter of the pump which enables it to be lowered into smaller diameter holes for fluid sampling purposes, and another important aspect is the construction which affords protection to the several fluid conveyance conduits and passageways used in the pump construction. Extending from the lower pump valve assembly 82 upwardly along the cylindrical body assembly 70 of the pump are a pair of elongated rigid manifold tubes 270 and 272. Both of these tubes are joined at their lower ends to ports formed in the lower pump valve assembly 82. Internally of the lower pump valve assembly 82, as it is actually constructed, the port (not shown) which communicates with the tubing 272 is communicated through suitable internal passageways with the radial suction port 262 which in turn, as previously explained, intersects and communicates with the axial suction port 260 for receiving sampled fluid drawn into the pump through the screen 84. From its point of connection to the described port formed in the flat top side of the cylindrical lower pump valve assembly 82, the tubing 272 extends substantially parallel to the plane of a flat surface 274 forming one of two opposed flat sides of the lower pump piston chamber 78. The opposite flat side 276 of the lower pump piston chamber is shown in FIG. 8. At its upper end, the lower pump piston chamber 78 carries a disc-shaped or cylindrical flange 278 which enables the lower pump piston chamber 78 to be secured by means of axially extending screws 280 to the seal plate 80 which closes the lower end of the lower motor piston chamber 74.

Figure 10:
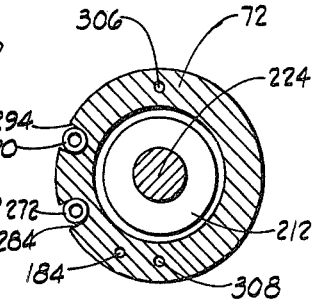
FIG. 10 is a sectional view taken along line 10—10 of FIG. 8.

As the manifold tubing 272, hereinafter referred to as the sample inlet manifold tubing, extends toward the top of the pump, it passes through recesses formed in the outer periphery of the cylindrical flange 278 of the lower pump piston chamber 78 and in the seal plate 80. These recesses are aligned with each other and with an elongated groove or recess formed in the outer surface of the wall of the lower motor piston chamber 74. In similar fashion, tubing-receiving recesses 281 are also formed in the disc-shaped end plates 76*b* and 76*c* at opposite ends of the axially extending central portion 76*a* of the cylinder connector 76, and an elongated recess or groove 284 is formed in the outer surface of the wall of the upper motor piston chamber 72 as is illustrated in the sectional view constituted by FIG. 10. The cross-sectional configuration of the recess 284 formed in the upper motor piston chamber 72 is identical to the cross-sectional configuration of the corresponding recess formed in the lower motor piston chamber 74, and the manner in which the sample intake manifold tubing 272 lies in those recesses is shown in FIG. 10. Registering grooves or recesses are provided in the seal plate 88 and in a cylindrical flange 286 formed at one end of the upper pump piston housing 86, in the same fashion and in the same diametric size relationship to the tubing 272 as the registering recesses formed in the lower seal plate 80 and cylindrical flange 278.

After passing through the aligned or registering recesses in the upper seal plate 88 and the flange 286, the sample intake manifold tubing 272 is bent downwardly into close proximity to a flat surface 290 constituted by one side of the upper pump piston housing 86, and from thence extends parallel to the plane of this surface to a point of connection of this tubing to a port formed in the upper pump valve assembly 90. Within the upper pump valve assembly 90, as it is actually constructed, internal fluid passageway means (not shown) connects the port to which the sample intake manifold tubing 272 is connected to the radial suction port 262 formed in the intake block 234 of the upper pump valve assembly 90. As previously explained, the axial suction port 260 of the upper pump valve assembly 90 is closed or blocked in the illustrated embodiment here under discussion. The effect of this is that when suction is taken through the intake or suction valve of the upper pump valve assembly 90, such suction is transferred via the manifold tubing conduit 272 to the intake or suction port 260 located at the bottom of the pump and adjacent the screen 84, and the fluid to be sampled is drawn through this screen, through the sample intake manifold tubing 272 and in through the suction or intake valve 258 located in the intake block 234 of the upper pump valve assembly 90. Subsequently, this sample fluid, originated at the bottom of the pump, will be discharged through the radial fluid passageway 238 and sample discharge port 240 in a manner to be shortly described.

The two discharge ports 240 located within the upper and lower pump valve assemblies 90 and 82, respectively, are manifolded together by means of an elongated sample discharged manifold tubing 270 which extends over a major portion of the length of the pump. The sample discharge manifold tubing 270 is connected at its lower end to a port formed in the flat top side of the cylindrical lower pump valve assembly 82. From this port, to which the sample discharge manifold tubing 270 is connected, internal porting or passageway means extends to a location within the discharge block 232 where fluid can be received from the radial fluid passageway 238 and sample discharge port 240. In other words, in actual construction, rather than opening out of the side of the pump, as schematically illustrated in FIGS. 5 and 6 of the drawings, the sample discharge port 240 in the lower pump valve assembly 82 opens into internal fluid passageway means which connects this port via a port in the top of the discharge block to the rigid sample discharge manifold tubing 270.

The rigid sample discharge tubing 270, like the sample intake or suction manifold 272, extends parallel to the plane of the flat side 274 of the lower pump piston chamber 78, and then is bent slightly outwardly to pass up through a pair of aligned or registering recesses formed in the cylindrical flange 278 and the lower seal plate 80. The rigid sample discharge tubing 270 then extends into an elongated groove or recess in the lower motor piston chamber 74 which extends parallel to the recess in which the sample intake manifold tubing 272 is accommodated, and is shaped substantially identically to the latter recess. Accommodating recesses 293 are also formed in the end plates 76*b* and 76*c* of the cylinder connector 76 and, as shown in FIG. 10, an elongated groove or recess 294 which extends parallel to the recess 284, and is identical thereto in cross-sectional configuration, receives and accommodates the tubing 270 in its upper course along the upper portion of the cylindrical body assembly 70. After passing through registering or mating recesses formed in the upper seal plate 88 and the disc-shaped flange 286 of the upper pump piston housing 86, the sample discharge manifold tubing 270 is bent downwardly into close proximity to the flat surface 290 at one side of the upper pump piston housing 86, and from thence extends parallel to the plane of this surface until the upper end of this tubing is sealingly connected to a port formed in the discharge block 234 of the upper pump valve assembly 90. Within the discharge block 234, internal fluid passageway means (not shown) is provided for placing the port into which the tubing 270 opens in communication with the sample discharge port 240 of the upper pump valve assembly 90.

It will thus be perceived that the discharge ports 240, which are present in identical form in the upper and lower pump valve assemblies 90 and 82, respectively, are manifold together and that, during alternate portions of the reciprocating stroke of the pump, a fluid sample is alternately received from the two discharge ports in the upper and lower pump valve assemblies 90 and 82. An internal passageway means (not shown) also extends from the highest point of manifolding of the two discharge ports to each other on up to the upper side of the upper pump valve assembly 90 where it opens through a port which is internally threaded to permit a nipple or fitting 297 secured to the lower end of the fluid sample surface return conduit or tubing 64 carried in the tube bundle to be attached thereto. In this fashion, the collected sample of fluid which, as the pump is constructed in the illustrated and described embodiment, is drawn through the suction screen 84 at the bottom of the pump, is ultimately discharged into the conduit 64 forming a part of the tube bundle 10, and from thence is conveyed to the surface for collection.

It will be apparent that the manner in which the recessing for the accommodating of the sample discharge manifold tubing 270 and the sample intake manifold tubing 272 is accomplished along the length of the pump body enables the manifold tubing to be protected from crimping or damage by contact with the well bore, and prevents the tubing from increasing the diametric dimension of the pump body.

Figure 9:
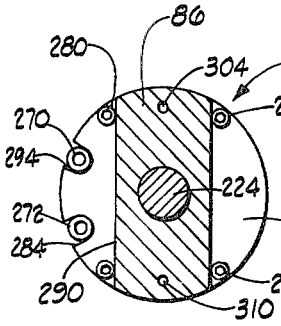
FIG. 9 is a sectional view taken along line 9—9 of FIG. 8.

For the purpose of conveying power fluid from the power fluid charging conduit 60 within the tube bundle 10 to the pilot valve subassembly 94 and distribution valve subassembly 96, a series of aligned internal fluid passageways are provided which extend through the upper portion of the pump to the central locus of the pilot valve subassembly and distribution valve subassembly. Thus, the power fluid charging conduit 60 from the tube bundle 10 is connected through a suitable fitting 299 to a threaded port which is formed in the upper side of the sample fluid intake block 234 of the upper pump valve assembly 90. This port (not shown) opens into an axially extending passageway (not shown) formed through the fluid intake block 234 and is aligned with an axially extending passageway (not shown) formed through the discharge block 232 of the upper pump valve assembly 90. The two axially extending passageways which are thus communicated with the port which receives the fitting 299 also communicate with an axially exending fluid passageway 304 formed in one side of the central portion of the tubular upper pump chamber 86 as shown in FIG. 9. The axially extending power fluid passageway 304 is aligned and in registry with a power fluid passageway 306 (as shown in FIG. 10) formed axially through the wall of the upper motor piston chamber 72 from one end thereof to the other. At the lower end of the upper motion piston chamber 72, the power fluid passageway 306 communicates with, and is sealingly coupled to, the power fluid passageway 171 which is formed in the cylinder connector 76, and is illustrated in FIG. 4B. The route of the pressurized power fluid from this passageway into the pilot valve subassembly 94 and the distribution valve subassembly 96 has been previously explained.

Although it is not illustrated in the schematic drawings portrayed in FIGS. 4A, 4B, 5 and 6, a similar arrangement is provided for conveying exhausted or spent power fluid from exhaust ports, such as those schematically illustrated at 121, 122, 172 and 174, to the upper end of the pump 14 for discharge at that location into the exhaust power fluid conduit 62 of the tube bundle 10, which conduit is secured to the top of the pump by means of a suitable fitting 309 which engages a power fluid exhaust port (not shown) in the upper end of the upper pump valve assembly 90. The route of exhausted power fluid from the pilot valve subassembly 94 and distribution valve subassembly 96 is axially through the interior of the cylindrical body assembly 70 via, inter alia, exhaust power fluid passageway 308 formed through the wall of the upper cylindrical motor piston chamber 72 and a registering axially extending exhaust power fluid passageway 310 formed through the upper pump piston housing 86 as shown in FIG. 9.

Figure 12:
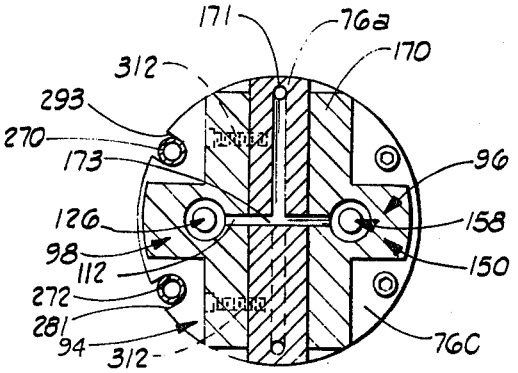
FIG. 12 is a diagrammatic sectional view of the central portion of the pump of the invention provided for the purpose of illustrating the construction of a cylinder connector, and of the pilot valve subassembly and distribution valve subassembly which are in the pump at that location.

To further facilitate the compact, small diameter construction of the pump 14 of the present invention, the central section of the cylindrical body assembly 70 which includes the cylinder connector 76, the pilot valve subassembly 94 and the distribution valve subassembly 96 is novelly constructed to interfit and mate these structures in the fashion best illustrated in FIG. 12 of the drawings. When this central structure is viewed in section as here shown, it will be perceived that the pilot valve subassembly 95 and the distribution valve subassembly 96 lie on opposite sides of the axially extending central portion **76*a* of the cylinder connector 76, and between the two cylindrical or disc-shaped end plates 76*b* and 76*c* of the cylinder connector. The pilot valve subassembly 94 and distribution valve subassembly 96 are configured so that they lie totally and entirely within the projected circumference or projected circular periphery of the two end plates 76*b* and 76*c*. In order to assure exact and proper registration and efficient sealing of the porting and fluid passageway systems which are provided through the central portion 76*a* of the cylinder connector 76 with the porting provided in the two valve subassemblies 94 and 96, the valve subassemblies are each secured to the opposite flat sides of the central portion 76*a* of the cylinder connector 76 by means of sets of screws 312 which engage precisely located threaded apertures formed at specific locations in the central portion 76*a* of the cylinder connector 76**.

The described method of assuring a high degree of precision in registration of passageways and ports within the pump is further facilitated by the use of axially extending screws 320 which are positioned in the pump body so as to provide access via axially extending recesses 322 formed in the portions of the upper and lower hollow cylindrical motor piston chambers 72 and 74 which are closely adjacent the opposite ends of the cylinder connector 76. This assures that as the pump may be assembled or disassembled during maintenance or repair, precise registration of the proper porting and internal passageways will always occur when the screws 320 have been screwed into position to interfit and secure the parts of the pump body to each other.

An alternate and preferred construction of the tube bundle reel assembly 22 is illustrated in FIGS. 13–16. As here shown, a reel drum 324 is shown in fragmentary cross-section, and is terminated at its opposite ends in stop plates 326. The flexible conduits or tubings 60, 62 and 64 utilized in the tube bundle 10 in the manner hereinbefore explained are brought in through the wall of the drum 324, extended through the apertures in the stop plate 326 and are passed through three radial openings 328, 330 and 332 formed in the wall of a hollow drum shaft 334 which is axially bored to permit the tubing to be extended through the axial bore to the opposite end of the drum shaft. The tubings 60, 62 and 64 are extended out of spaced radial openings 336, 338 and 340 provided at that location. The drum shaft 334 is journalled in suitable bearings 342 set in bearing races carried by a pillow block 344 which supports and journals the drum shaft 334 for rotation.

Figure 14:
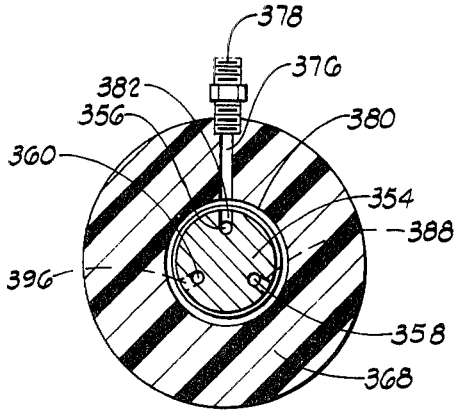
FIG. 14 is a sectional view taken along line 14—14 of FIG. 13.
Figure 15:
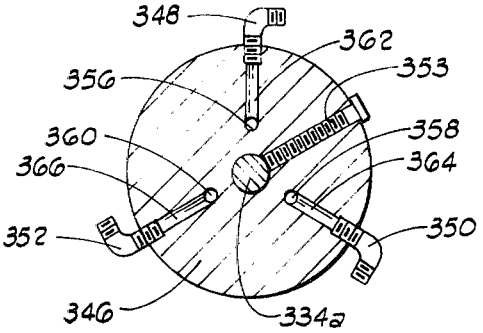
FIG. 15 is a sectional view taken along line 15—15 of FIG. 13.
Figure 16:
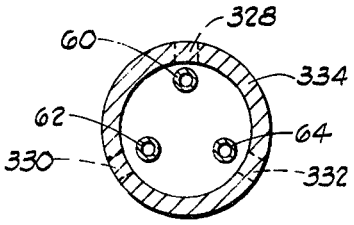
FIG. 16 is a sectional view taken along line 16—16 of FIG. 13.

Secured to the outer end of the drum shaft 334 is a connector block 346 which carries a plurality of peripherally mounted, circumferentially spaced nipples 348, 350 and 352 as shown in FIG. 15. The connector block 346 is keyed to a hub **334*a* of the drum shaft 334 by means of a set screw 353. The connector block 346 includes, in addition to the relatively large cylindrical end portion which carries the nipples 348–352, a cylindrical manifold extension 354, shown in FIG. 14, which projects coaxially with the drum shaft 334. The cylindrical manifold extension 354 includes three axially extending, substantially parallel bores 356, 358 and 360 which are spaced 120° from each other on a circle scribed concentrically about the axis of the manifold extension. This arrangement is illustrated in FIG. 14. Within the enlarged cylindrical end portion of the connector block 346, the bores 356, 358 and 360 are intersected by radial passageways 362, 364 and 366 which place the bores in communication with the nipples 348, 350 and 352**.

The cylindrical manifold extension 354 of the connector block 346 has three contiguous synthetic resin stator blocks 368, 370 and 372 journalled around the outer periphery thereof, and retained by a retainer washer 373 secured by a screw 375 to the end of the manifold extension 354. Each of the stator blocks 368, 370 and 372 is cylindrical in configuration and is constructed of a synthetic resin having high strength and a low coefficient of friction. Each of the stator blocks is provided with a radially extending passageway. Thus, the stator block 368 defines the radial passageway 376 which extends from a connection nipple 378 at the outer periphery of the block inwardly to a point of intersection with an annular fluid collection channel 380 formed in the stator block around the manifold extension 354. The annular fluid collection channel 380 is positioned to receive fluid discharged through a port 382 formed through the outer wall of the manifold extension 354 to intersect the bore 356.

The stator block 370 simmilarly defines a radial passageway 384 which extends from a connection nipple 385 and opens at its inward end in an annular fluid collection channel 386. The annular fluid collection channel 386 is positioned around manifold extension 354 at a location to transfer fluid through a port 388 which opens through the outer wall of the manifold extension to intersect the axial bore 358. Lastly, the stator block 372 defines the radial passageway 390 which extends from a connection nipple 392 to an annular fluid collection channel 394 located at its inner end. The annular fluid collection channel 394 registers with a port 396 which opens through the wall of the manifold extension 354 into the axial bore 360.

The synthetic resin stator blocks 368, 370 and 372 are stationary during operation of the reel assembly 22 and are mounted in a fixed position on a bracket 398 which is supported upon a plate extension 400 from the base 402 of the pillow block 344.

In the operation of the embodiment of the tube bundle reel assembly 22 depicted in FIGS. 13–16, the power fluid to be charged to the pump carried in the tubing 60 is introduced through any suitable conduit connected to the nipple 378. The power fluid passes through the radial passageway 376, through the port 382 and on into the axial bore 356 in the manifold extension 354. Upon entering the enlarged cylindrical end portion of the connector block 346, the power fluid passes out through the radial passageway 362 into the nipple 348, and from this nipple enters the tubing 60. This charging of the power fluid is facilitated by the stationary status of the synthetic resin stator blocks in relation to the cylindrical manifold extension 354 of the connector block 356 which rotates with the drum 324. The nipple 378 and passageway 376 are continuously communicated with the port 382 and axial bore 356 by means of the annular fluid collection channel 380.

In similar fashion, exhaust power fluid carried to the surface in the tubing 62 is passed from this tubing into the nipple 350, from the nipple 350 through the radial passageway 364 and ultimately into the axial bore 358 formed in the connector block 346 and extending on into the manifold extension 354. The exhaust power fluid is ultimately removed via the nipple 385 carried by the stator block 370.

The course of a fluid sample delivered by the pump to the surface via the tubing 64 is similar to that described as experienced by the exhaust power fluid, except that the pumped sample passes through the axial bore 360 and is ultimately collected via the collection nipple 392 carried at the radially outer end of the radial passageway 390 formed in the synthetic resin stator block 372.

Although certain preferred embodiments of the present invention have been herein described in order to afford clear examples of the principles of construction and utilization which underlie the invention, it will be understood that various changes and innovations of the specific structures used, and their arrangements relative to each other within the pump assembly, can be undertaken without departure from the basic principles underlying the invention. Changes and innovations of this type are therefore deemed to be circumscribed by the spirit and scope of the invention except as the same may be necessarily limited by the appended claims or reasonable equivalents thereof.

What is claimed is:

1. A fluid-powered sampling pump system comprising:

a tube bundle reel assembly;

a tube bundle reeled upon said reel assembly and including:

a fluid sample tubing;

a power fluid charging tubing; and an exhaust power fluid tubing;

a pump connected to one end of said tube bundle for lowering into the earth, said pump comprising:

a hollow cylindrical upper motor piston chamber defining an axially extending fluid passageway in the wall thereof for receiving pressurized power fluid from said power fluid charging tubing, and further defining an axially extending fluid passageway in the wall thereof for delivering exhaust power fluid to said exhaust power fluid tubing;

an upper motor piston in said upper motor piston chamber;

a hollow cylindrical lower motor piston chamber;

means detachably interconnecting said upper and lower motor piston chambers and positioned therebetween to facilitate independent removal of said motor piston chambers from the pump;

a lower motor piston in said lower motor piston chamber;

means interconnecting said upper and lower motor pistons for concurrent movement within their respective piston chambers;

a lower pump piston chamber connected to said lower motor piston chamber;

an upper pump piston chamber connected to said upper motor piston chamber;

an upper pump piston connected to said upper motor piston and having a portion positioned in said upper pump piston chamber for reciprocation therein during the concurrent reciprocation of said upper motor piston;

a lower pump piston having a portion positioned in said lower pump piston chamber and connected to said lower motor piston for reciprocation in said lower pump piston chamber when said lower motor piston undergoes reciprocation;

a lower pump valve subassembly connected to said lower pump piston chamber and including an intake valve and a discharge valve;

an upper pump valve subassembly connected to said upper pump piston chamber and including an intake valve and a discharge valve;

manifold tubing means commonly interconnecting said discharge valves to said fluid sample tubing of said tube bundle;

a pilot valve subassembly interposed between said upper and lower motor piston chambers and detachably mounted on said means interconnecting said upper and lower motor piston chambers;

a distribution valve subassembly interposed between said upper motor piston chamber and said lower motor piston chamber and detachably mounted on said means interconnecting said upper and lower motor piston chambers, said distribution valve subassembly being operatively connected to said pilot valve subassembly and to said motor pistons to respond to shifting movement of said pilot valve subassembly during operation of the pump, and to distribute power fluid to said motor pistons; and means interconnecting said pilot valve subassembly and said distribution valve subassembly with said axial fluid passageways in said upper motor piston chamber.

2. A fluid-powered sampling pump comprising:

a cylindrical body assembly which includes:
a hollow cylindrical upper motor piston chamber;
a hollow cylindrical lower motor piston chamber;

a cylinder connector interconnecting said upper and lower motor piston chambers and positioned therebetween;
an upper motor piston in said upper motor piston chamber;
a lower motor piston in said lower motor piston chamber;

an elongated piston connecting rod interconnecting said upper and lower motor pistons;

a lower pump piston chamber connected to the opposite side of said lower motor piston chamber from said cylinder connector;

an upper pump piston chamber connected to the opposite side of said upper motor piston chamber from said cylinder connector;

an upper pump piston positioned in said upper pump piston chamber for reciprocation therein and connected to said upper motor piston;

a lower pump piston postioned in said lower pump piston chamber for reciprocation therein and connected to said lower motor piston;

a lower pump valve subassembly connected to said lower pump piston chamber, said lower pump valve subassembly including:
an intake valve; and
a discharge valve;

an upper pump valve subassembly connected to said upper pump piston chamber, said upper pump valve subassembly including:
an intake valve; and
a discharge valve;

a pilot valve subassembly carried by said cylinder connector and disposed between said motor piston chambers, said pilot valve subassembly comprising:
a valve body having bores at its opposite ends;
seal plugs closing said bores at opposite ends of the valve body;
a large central piston chamber in said valve body;
a relatively small piston chamber in said valve body between said large central chamber and one of said seal plugs;
a relatively larger piston chamber of larger diameter than said small piston chamber and located in said valve body on the other side of said large central piston chamber from said relatively small piston chamber;

a spool in said valve body and including:
a large central piston in said central chamber;
a relatively small piston in said relatively small piston chamber;
a relatively larger piston in said relatively larger piston chamber;
an elongated shaft interconnecting the pistons of said spool;
a power fluid charging port through said valve body communicating with said central piston chamber; and
a seal around said large central piston dimensioned to only partially seal said charging port as said central piston crosses said power fluid charging port during reciprocation of said spool whereby pressurized power fluid may pass to the opposite sides of said large central piston and act simultaneously upon said relatively small spool piston and upon said relatively larger spool piston;

a distribution valve subassembly carried by said cylinder connector and disposed between said motor piston chambers;

first fluid passageway means interconnecting said pilot valve subassembly and distribution valve subassembly;

second fluid passageway means interconnecting said distribution valve subassembly and each of said motor piston chambers, said second fluid passageway means including
first means for conveying fluid between said distribution valve subassembly and the opposite ends of said upper motor piston chamber on opposite sides of said upper motor piston; and
second means for conveying fluid between said distribution valve subassembly and the opposite ends of said lower motor piston chamber on the opposite sides of said lower motor piston;

means for charging a power fluid concurrently to said pilot valve subassembly and said distribution valve subassembly; and tubing means for receiving a pumped fluid sample from each of said discharge valves.

3. In a pump of the type which includes a motor piston, a cylindrical motor piston chamber around the motor piston, a pump piston connected to the motor piston for reciprocation therewith, a pump piston chamber around the pump piston, and intake and discharge valves connected to the pump piston chamber and responsive to movement of the pump piston to alternately open and close for pumping a fluid, the improvement which comprises:

a spool-type pilot valve including a valve body and a spool and lying to one side of the axis of the motor piston chamber and within the projected circumference of the cylindrical motor piston chamber, said spool-type pilot valve further comprising:
a large central first piston chamber;
a second piston chamber;
a third piston chamber of a diametric size which is intermediate between said central and second piston chambers and located on the opposite side of said central chamber from said second piston chamber;

a power fluid charging port communicating with said central piston chamber;

a spool constituting a compound piston subassembly which includes:

a first, relatively small diameter piston reciprocally mounted in said second piston chamber and having a first annular elastomeric sealing element extending therearound;

a second piston of larger diameter than said first piston reciprocally mounted in said third piston chamber and having a second annular elastomeric sealing element extending therearound; and a third piston of larger diameter than said second piston reciprocally mounted in said central piston chamber and having a third elastomeric sealing element extending therearound, said third elastomeric sealing element having a size in relation to said power fluid charging port such that said port is not completely sealed and power fluid bypasses said sealing element to opposite sides of said third piston;

a spool-type fluid distribution valve lying to one side of the axis of the motor piston chamber and within the projected circumference of the cylindrical motor piston chamber;

means interconnecting the pilot valve and fluid distribution valve for shifting the fluid distribution valve in response to a shift of the pilot valve;

fluid distribution means interconnecting the fluid distribution valve and the motor piston chamber for reciprocating the motor piston in synchronization with the shifting of said fluid distribution valve; and a push rod extending parallel to the axis of said motor piston chamber and extending from the inside to the outside of said motor piston chamber and into said pilot valve body in a line between said motor piston and the spool of said pilot valve.

4. A fluid-powered sampling pump comprising:

a cylindrical body assembly which includes:

a hollow cylindrical upper motor piston chamber;

a hollow cylindrical lower motor piston chamber;

a cylinder connector interconnecting said upper and lower motor piston chambers and positioned therebetween;

an upper motor piston in said upper motor piston chamber;

a lower motor piston in said lower motor piston chamber;

an elongated piston connecting rod interconnecting said upper and lower motor pistons;

a lower pump piston chamber connected to the opposite side of said lower motor piston chamber from said cylinder connector;

an upper pump piston chamber connected to the opposite side of said upper motor piston chamber from said cylinder connector;

an upper pump piston positioned in said upper pump piston chamber for reciprocation therein and connected to said upper motor piston;

a lower pump piston positioned in said lower pump piston chamber for reciprocation therein and connected to said lower motor piston;

a lower pump valve subassembly connected to said lower pump piston chamber, said lower pump valve subassembly including:

an intake valve; and a discharge valve;

an upper pump valve subassembly connected to said upper pump piston chamber, said upper pump valve subassembly including:

an intake valve; and a discharge valve;

a pilot valve subassembly carried by said cylinder connector and disposed between said motor piston chambers;

a distribution valve subassembly carried by said cylinder connector and disposed between said motor piston chambers;

first fluid passageway means interconnecting said pilot valve subassembly and distribution valve subassembly;

second fluid passageway means interconnecting said distribution valve subassembly and each of said motor piston chambers, said second fluid passageway means including:

first means for conveying fluid between said distribution valve subassembly and the opposite ends of said upper motor piston chamber on opposite sides of said upper motor piston; and second means for conveying fluid between said distribution valve subassembly and the opposite ends of said lower motor piston chamber on the opposite sides of said lower motor piston;

means for charging a power fluid concurrently to said pilot valve subassembly and said distribution valve subassembly; and tubing means for receiving a pumped fluid sample from each of said discharge valves;

said cylinder connector comprising:

a central portion having a bore therethrough slidingly receiving said elongated piston connecting rod, said central portion having two opposed, substantially parallel flat sides; and a pair of spaced, cylindrical end plates on opposite end of said central portion and slidingly receiving said piston connecting rod therethrough;

and wherein said pilot valve subassembly is secured to one of said flat sides of said central portion between said end plates; and said distribution valve subassembly is secured to the other flat side of said central portion between said end plates.

5. A fluid-powered sampling pump as defined in claim 4 wherein said pilot valve subassembly comprises:

a valve body having bores at its opposite ends;

seal plugs closing said bores at opposite ends of the valve body;

a large central piston chamber in said valve body;

a relatively small piston chamber in said valve body between said large central chamber and one of said seal plugs;

a relatively larger piston chamber of larger diameter than said small piston chamber and located in said valve body on the other side of said large central piston chamber from said relatively small piston chamber; and a spool in said valve body and including:

a large central piston in said central chamber;

a relatively small piston in said relatively small piston chamber;

a relatively larger piston in said relatively larger piston chamber; and an elongated shaft interconnecting the pistons of said spool.

6. A fluid-powered sampling pump as defined in claim 5 and further characterized as including:

a first push rod extending slidingly through one of said end plates and one of said seal plugs and having a first end in said upper motor piston chamber in the path of movement of the upper motor piston and a second end aligned with said elongated shaft of said spool; and a second push rod extending slidingly through the other of said end plates and the second of said seal plugs and having a first end in said lower motor piston chamber in the path of movement of said lower motor piston and a second end aligned with said elongated shaft of said spool.

7. In a pump of the type which includes a motor piston, a cylindrical motor piston chamber around the motor piston, a pump piston connected to the motor piston for reciprocation therewith, a pump piston chamber around the pump piston, and intake and discharge valves connected to the pump piston chamber and responsive to movement of the pump piston to alternately open and close for pumping a fluid, the improvement which comprises:

a spool-type pilot valve including a valve body and a spool and lying to one side of the axis of the motor piston chamber and within the projected circumference of the cylindrical motor piston chamber;

a spool-type fluid distribution valve lying to one side of the axis of the motor piston chamber and within the projected circumference of the cylindrical motor piston chamber;

means interconnecting the pilot valve and fluid distribution valve for shifting the fluid distribution valve in response to a shift of the pilot valve;

fluid distribution means interconnecting the fluid distribution valve and the motor piston chamber for reciprocating the motor piston in synchronization with the shifting of said fluid distribution valve;

a push rod extending parallel to the axis of said motor piston chamber and extending from the inside to the outside of said motor piston chamber and into said pilot valve body in a line between said motor piston and the spool of said pilot valve; and valve supporting means supporting said pilot valve and distribution valve and comprising:

a central portion which is disposed in coaxial alignment with the axis of said motor piston chamber and extends between said pilot valve and fluid distribution valve;

a pair of axially spaced disc-shaped, cylindrical end plates connected to opposite ends of said central portion and lying on opposite sides of said pilot valve and fluid distribution valve; and screw means detachably mounting said pilot valve and distribution valve on said central portion at a location within a volume defined within a cylindrical boundary established by the projection of the cylindrical outer peripheries of said end plates.

8. The pump of claim 7 wherein said central portion includes power fluid charging passageway means, and wherein said pilot valve and distribution valve each include power fluid charging ports registering and communicating with said power fluid charging passageway means to receive power fluid therefrom.

9. The pump of claim 8 wherein said pilot valve comprises:

an elongated spool having a relatively large diameter central piston, a relatively smaller diameter piston at one end of the spool, and a third piston at the opposite end of the spool having a diameter intermediate in size between that of the central piston and the relatively smaller diameter piston; and an annular elastomeric sealing element around said central piston sized to allow power fluid by-pass to opposite sides of the central piston when the central piston and said elastomeric sealing element therearound are centered over the power fluid charging port of said pilot valve.

10. In a pump of the type which includes a motor piston, a cylindrical motor piston chamber around the motor piston, a pump piston connected to the motor piston for reciprocation therewith, a pump piston chamber around the pump piston, and intake and discharge valves connected to the pump piston chamber and responsive to movement of the pump piston to alternately open and close for pumping a fluid, the improvement which comprises:

a spool-type pilot valve including a valve body and a spool and lying to one side of the axis of the motor piston chamber and within the projected circumference of the cylindrical motor piston chamber;

a spool-type fluid distribution valve lying to one side of the axis of the motor piston chamber and within the projected circumference of the cylindrical motor piston chamber;

means interconnecting the pilot valve and fluid distribution valve for shifting the fluid distribution valve in response to a shift of the pilot valve;

fluid distribution means interconnecting the fluid distribution valve and the motor piston chamber for reciprocating the motor piston in synchronization with the shifting of said fluid distribution valve;

a push rod extending parallel to the axis of said motor piston chamber and extending from the inside to the outside of said motor piston chamber and into said pilot valve body in a line between said motor piston and the spool of said pilot valve; and means detachably supporting said spool-type pilot valve, said spool-type distribution valve and said motor piston chambers for individual, independent and selective detachment of said pilot valve, distribution valve and motor piston chambers from said pump.

11. The pump of claim 10 wherein said supporting means comprises:

a central portion which is disposed in coaxial alignment with the axis of said motor piston chamber and extends between said pilot valve and fluid distribution valve;

a pair of axially disc-shaped, cylindrical end plates connected to opposite ends of said central portion and lying on opposite sides of said pilot valve and fluid distribution valve; and screw means detachably mounting said pilot valve and distribution valve on said central portion at a location within a volume defined within a cylindrical boundary established by the projection of the cylindrical outer peripheries of said end plates.

12. The pump of claim 10 further characterized as including:

a pair of elongated recesses defined in said motor piston chamber at the outer periphery thereof and extending axially along the motor piston chamber; and a fluid discharge tube connected to said discharge valve and extending into and along one of said elongated recesses.

13. A pump as defined in claim 10 wherein said pilot valve body defines a large central first piston chamber, a second piston chamber, a third piston chamber of a diametric size which is intermediate between said central and second piston chambers and located on the opposite side of said central chamber from said second piston chamber, and a power fluid charging port communicating with said central piston chamber, and said pilot valve further comprises:

a spool constituting a compound piston subassembly which includes:

a first, relatively small diameter piston reciprocally mounted in said second piston chamber and having a first annular elastomeric sealing element extending therearound;

a second piston of larger diameter than said first piston reciprocally mounted in said third piston chamber and having a second annular elastomeric sealing element extending therearound; and a third piston of larger diameter than said second piston reciprocally mounted in said central piston chamber and having a third elastomeric sealing element extending therearound, said third elastomeric sealing element having a size in relation to said power fluid charging port such that said port is not completely sealed and power fluid bypasses said sealing element to opposite sides of said third piston.

14. A fluid-powered sampling pump comprising:

a cylindrical body assembly which includes:

a hollow cylindrical upper motor piston chamber;

a hollow cylindrical lower motor piston chamber;

a cylinder connector detachably interconnecting said upper and lower motor piston chambers and positioned therebetween;

an upper motor piston in said upper motor piston chamber;

a lower motor piston in said lower motor piston chamber;

an elongated piston connecting rod interconnecting said upper and lower motor pistons;

a lower pump piston chamber connected to the opposite side of said lower motor piston chamber from said cylinder connector;

an upper pump piston chamber connected to the opposite side of said upper motor piston chamber from said cylinder connector;

an upper pump piston positioned in said upper pump piston chamber for reciprocation therein and connected to said upper motor piston;

a lower pump piston positioned in said lower pump piston chamber for reciprocation therein and connected to said lower motor piston;

a lower pump valve subassembly connected to said lower pump piston chamber, said lower pump valve subassembly including:

an intake valve; and a discharge valve;

an upper pump valve subassembly connected to said upper pump piston chamber, said upper pump valve subassembly including:

an intake valve; and a discharge valve;

a pilot valve subassembly detachably carried by said cylinder connector and disposed between said motor piston chambers;

a distribution valve subassembly detachably carried by said cylinder connector and disposed between said motor piston chambers;

first fluid passageway means interconnecting said pilot valve subassembly and distribution valve subassembly;

second fluid passageway means interconnecting said distribution valve subassembly and each of said motor piston chambers, said second fluid passageway means including first means for conveying fluid between said distribution valve subassembly and the opposite ends of said upper motor piston chamber on opposite sides of said upper motor piston; and second means for conveying fluid between said distribution valve subassembly and the opposite ends of said lower motor piston chamber on the opposite sides of said lower motor piston;

means for charging a power fluid concurrently to said pilot valve subassembly and said distribution valve subassembly; and tubing means for receiving a pumped fluid sample from each of said discharge values.

15. A fluid-powered sampling pump as defined in claim 14 and further characterized as including:

a rigid sample discharge manifold tubing interconnecting the discharge valves of said upper and lower pump valve subassembly; and a rigid sample intake manifold tubing interconnecting the intake valves of said upper and lower pump valve subassemblies.

16. A fluid-powered sampling pump as defined in claim 15 wherein said upper motor piston chamber and lower motor piston chamber each are provided with axially extending, elongated recesses in the outer walls thereof for receiving and accommodating said sample discharge manifold tubing and said sample intake manifold tubing whereby said discharge and intake manifold tubings are retained and carried within the circumferential peripheries of said upper motor piston chamber and said lower motor piston chamber by their positioning in said recesses.

17. A fluid-powered sampling pump as defined in claim 14 wherein said cylinder connector comprises:

a central portion having a bore therethrough slidingly receiving said elongated piston connecting rod, said central portion having two opposed, substantially parallel flat sides;

a pair of spaced, cylindrical end plates on opposite ends of said central portion and slidingly receiving said piston connecting shaft therethrough;

and wherein said pilot valve subassembly is secured to one of said flat sides of said central portion between said end plates; and said distribution valve subassembly is secured to the other flat side of said central portion between said end plates.

18. A fluid-powered sampling pump as defined in claim 14 wherein said pilot valve subassembly comprises:

a valve body having bores at its opposite ends;

seal plugs closing said bores at opposite ends of the valve body;

a large central piston chamber in said valve body;

a relatively small piston chamber in said valve body between said large central chamber and one of said seal plugs;

a relatively larger piston chamber of larger diameter than said small piston chamber and located in said valve body on the other side of said large central piston chamber from said relatively small piston chamber; and a spool in said valve body and including:

a large central piston in said central chamber;

a relatively small piston in said relatively small piston chamber;

a relatively larger piston in said relatively larger piston chamber; and an elongated shaft interconnecting the pistons of said spool.

19. A fluid-powered sampling pump as defined in claim 18 wherein said pilot valve subassembly is further characterized in including:

a power fluid charging port through said valve body communicating with said central piston chamber; and a seal around said large central piston dimensioned to only partially seal said charging port as said central piston crosses said power fluid charging port during reciprocation of said spool whereby pressurized power fluid may pass to the opposite sides of said large central piston and act simultaneously upon said relatively small spool piston and upon said relatively larger spool piston.

20. A fluid-powered sampling pump as defined in claim 14 wherein said charging means comprises:

axially extending aligned elongated fluid passageways within the wall of said upper motor piston chamber and of said upper pump piston chamber; and a power fluid passageway means in said cylinder connector intercommunicating said passageway in said upper motor piston chamber with the pilot valve subassembly and distribution valve subassembly.

21. A fluid-powered sampling pump as defined in claim 20 wherein said cylinder connector comprises:

a central portion having a bore therethrough slidingly receiving said elongated piston connecting rod, said central portion having two opposed, substantially parallel flat sides;

a pair of spaced, cylindrical end plates on opposite ends of said central portion and slidingly receiving said piston connecting rod therethrough;

and wherein said pilot valve subassembly is secured to one of said flat sides of said central portion between said end plates; and said distribution valve subassembly is secured to the other flat side of said central portion between said end plates.

22. A fluid-powered sampling pump as defined in claim 21 and further characterized as including:

a rigid sample discharge manifold tubing interconnecting the discharge valves of said upper and lower pump valve subassembly; and a rigid sample intake manifold tubing interconnecting the intake valves of said upper and lower pump valve subassemblies.

23. A fluid-powered sampling pump as defined in claim 22 wherein said upper motor piston chamber and lower motor piston chamber each are provided with axially extending, elongated recesses in the outer walls thereof for receiving and accommodating said sample discharge manifold tubing and said sample intake manifold tubing.

24. A fluid-powered sampling pump as defined in claim 23 wherein said pilot valve subassembly comprises:

a valve body having bores at its opposite ends;

seal plugs closing said bores at opposite ends of the valve body;

a large central piston chamber in said valve body;

a relatively small piston chamber in said valve body between said large central chamber and one of said seal plugs;

a relatively larger piston chamber or larger diameter than said small piston chamber and located in said valve body on the other side of said large central piston chamber from said relatively small piston chamber; and a spool in said valve body and including:

a large central piston in said central chamber;

a relatively small piston in said relatively small piston chamber;

a relatively larger piston in said relatively larger piston chamber; and an elongated shaft interconnecting the pistons of said spool.

25. A fluid-powered sampling pump as defined in claim 24 and further characterized as including:

a first push rod extending slidingly through one of said end plates and one of said seal plugs and having a first end in said upper motor piston chamber in the path of movement of the upper motor piston and a second end aligned with said elongated shaft of said spool; and a second push rod extending slidingly through the other of said end plates and the second of said seal plugs and having a first end in said lower motor piston chamber in the path of movement of said lower motor piston and a second end aligned with said elongated shaft of said spool.

* * * * *

UNITED STATES PATENT AND TRADEMARK OFFICE

CERTIFICATE OF CORRECTION

PATENT NO. : 4,295,801

DATED : October 20, 1981

INVENTOR(S) : Robert W. Bennett

It is certified that error appears in the above-identified patent and that said Letters Patent are hereby corrected as shown below:

Column 3, line 2 - delete "pivot" and insert --pilot--.

Column 17, line 22 - insert "piston" between pump and chamber.

Column 17, line 27 - delete "motion"and insert --motor--.

In the Claims:

Column 24, line 35 - delete "end" and insert --ends--.

Column 29, line 31 - delete "wall" and insert --walls--.

Column 30, line 26 - delete "or" and insert --of--.

Signed and Sealed this

*Fifth* Day of *January 1982*

[SEAL]

*Attest:*

GERALD J. MOSSINGHOFF

*Attesting Officer*

*Commissioner of Patents and Trademarks*